US010246963B2

(12) United States Patent
Dailey, Jr. et al.

(10) Patent No.: US 10,246,963 B2
(45) Date of Patent: Apr. 2, 2019

(54) SYSTEM AND METHOD FOR DEPLOYING AND USING AT LEAST ONE CONTROL MODULE FOR IN-RISER AND OPEN WATER OPERATIONS

(71) Applicant: Schlumberger Technology Corporation, Sugar Land, TX (US)

(72) Inventors: Terrell Eugene Dailey, Jr., Sugar Land, TX (US); Pawas Shukla, Pearland, TX (US); Boris Martinez, Missouri City, TX (US); Rebecca Moore, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/403,668

(22) Filed: Jan. 11, 2017

(65) Prior Publication Data

US 2017/0198542 A1 Jul. 13, 2017

Related U.S. Application Data

(60) Provisional application No. 62/277,092, filed on Jan. 11, 2016.

(51) Int. Cl.
*E21B 34/04* (2006.01)
*E21B 41/00* (2006.01)
(Continued)

(52) U.S. Cl.
CPC ..... *E21B 33/0355* (2013.01); *E21B 41/0007* (2013.01); *E21B 34/045* (2013.01); *E21B 47/06* (2013.01)

(58) Field of Classification Search
CPC .. E21B 47/06; E21B 33/0355; E21B 41/0007; E21B 34/045
See application file for complete search history.

(56) References Cited

U.S. PATENT DOCUMENTS 6,125,938 A * 10/2000 Garcia-Soule ..... E21B 33/0355 166/336
8,839,868 B2 * 9/2014 Scranton ..... E21B 34/045 166/360
(Continued)

FOREIGN PATENT DOCUMENTS

CA 2860639 A1 7/2013
WO 8602696 A1 5/1986
(Continued)

OTHER PUBLICATIONS

Search and Examination Report issued in Great Britain Patent Application No. GB1700499.5 dated May 2, 2017; 7 pages.

*Primary Examiner* — James G Sayre
(74) *Attorney, Agent, or Firm* — Brandon S. Clark

(57) ABSTRACT

A technique facilitates control of subsea equipment by providing a modular electro-hydraulic control system which can be used with various types of subsea equipment. The modular system is constructed to accommodate high axial loading while also withstanding high bending forces. Additionally, the components of the modular system are constructed and arranged to enable the modular system to fit through a rotary table of a rig. Depending on the parameters of a given application, the modular control system may be utilized for open water operations and in-riser operations.

20 Claims, 5 Drawing Sheets

(51) Int. Cl.
*E21B 47/06* (2012.01)
*E21B 33/035* (2006.01)

(56) References Cited

U.S. PATENT DOCUMENTS

| | | | | |
|---|---|---|---|---|
| 9,222,320 | B2 * | 12/2015 | Varpe | E21B 21/106 |
| 2002/0053438 | A1 * | 5/2002 | Williamson, Jr. | E21B 34/10 166/373 |
| 2005/0217845 | A1 * | 10/2005 | McGuire | E21B 33/0355 166/100 |
| 2014/0374114 | A1 * | 12/2014 | Brock | E21B 41/0007 166/340 |

FOREIGN PATENT DOCUMENTS

| | | | |
|---|---|---|---|
| WO | 2013032987 | A1 | 3/2013 |
| WO | 2015052499 | A2 | 4/2015 |

* cited by examiner

SYSTEM AND METHOD FOR DEPLOYING AND USING AT LEAST ONE CONTROL MODULE FOR IN-RISER AND OPEN WATER OPERATIONS

CROSS-REFERENCE TO RELATED APPLICATIONS

This application claims the benefit of U.S. Provisional Patent Application No. 62/277,092, filed Jan. 11, 2016, of which is herein incorporated by reference in its entirety.

BACKGROUND

In a variety of subsea applications, many types of equipment may be deployed down through a marine riser and/or through the open water to a subsea well. The equipment is deployed to the subsea well, and each distinct system or tool has its own specific control system for controlling the various tool functions at the subsea location. For example, subsea test trees, tubing hangar running tools, and/or tree running tools may be deployed to the subsea well with their own specific control systems. Because each type of tool or equipment is coupled with its own dedicated control system, the change-over time between completing one operation and beginning another can be substantial. Additionally, the size of many of the control systems dictates that rig-up operations be performed in the moon pool area of a drilling rig rather than the rig floor which can create additional time requirements and complexities.

SUMMARY

In general, the present disclosure is related to a system and methodology which provide a modular electro-hydraulic control system which can be used with various types of subsea equipment. The modular system is constructed to accommodate high axial loading while also withstanding high bending forces. Additionally, the components of the modular system are constructed and arranged to enable the modular system to fit through a rotary table of a drilling rig. Depending on the parameters of a given application, the modular control system may be utilized for open water operations and in-riser operations.

BRIEF DESCRIPTION OF THE DRAWINGS

Certain embodiments will hereafter be described with reference to the accompanying drawings, wherein like reference numerals denote like elements. It should be understood, however, that the accompanying figures illustrate various implementations described herein and are not meant to limit the scope of various technologies described herein, and.

DETAILED DESCRIPTION

Figure 1:
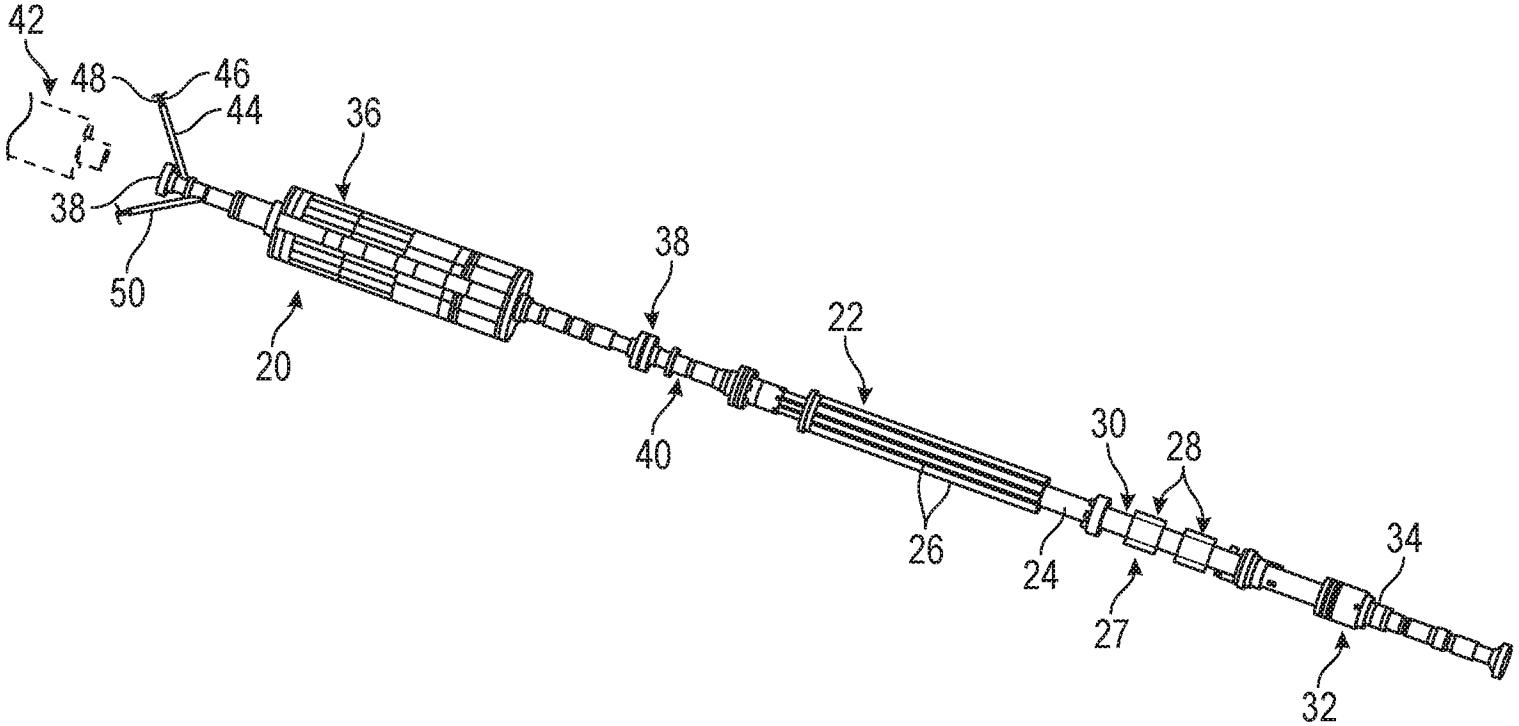
FIG. 1 is an illustration of an example of a modular control system which may be used in subsea operations, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology for facilitating control over various types of subsea equipment, e.g. equipment deployed on drill pipe or other suitable conveyances. The system and methodology utilize a modular electro-hydraulic control system which can be readily assembled and used with various types of subsea equipment. The configuration of the modular system accommodates high axial loading while also withstanding high bending forces. As described in greater detail below, the modular electro-hydraulic control system utilizes at least one control module which is constructed to fit through a rotary table of a drilling rig, thus simplifying deployment of the subsea equipment. Depending on the parameters of a given application, the modular control system may be utilized for open water operations and in-riser operations.

According to a specific embodiment, the modular control system is constructed for deployment on drill pipe in an open water environment or through a marine riser. The construction and modularity of the system enables control of several different types of equipment, e.g. a subsea test tree (SSTT), a tubing hanger running tool (THRT) and/or a tree running tool (TRT), instead of using specific, dedicated control systems for each type of equipment. The modular control system may be deployed through a rig's rotary table, thus reducing change-over time between completing one subsea operation and beginning another. Because the components of the modular control system may be deployed through the rotary table, various additional rig-up operations can be moved to the rig floor rather than being performed in a moon pool area of the rig, thus further reducing time of assembly. The use of one control system rather than several different control systems also saves costs otherwise associated with the purchase or rental of the additional control equipment.

The modular control system may be constructed to utilize a variety of components depending on the parameters of a given operation. For example, the modular control system may comprise an inner mandrel which carries well fluids therethrough and also attaches to a suitable conveyance, e.g. drill pipe. The inner mandrel may be changed depending on the pressures and tensions involved in a given well application. By way of example, the inner mandrel may have flange connections at its ends to facilitate connection with other modules. Devices such as accumulators, regulators, and hydraulic manifolds may be selectively mounted to the outside of the inner mandrel to facilitate control over the subsea equipment, e.g. to supply hydraulic power and/or chemical injection for the SSTT and THRT. An instrumentation module also may be mounted on the inner mandrel to, for example, measure pressure on the hydraulic output lines.

The entire assembly may be constructed to fit through a rotary table and to move along the inside of a marine riser for in-riser operations.

A second module, e.g. an open water control module, may be coupled into the modular control system. By way of example, the second module may comprise additional accumulators, manifolds, and other devices mounted on a second internal mandrel. The second module also may utilize flange connections or other suitable connections for coupling with other components of the overall modular control system. The second control module also is constructed to fit through the rotary table and may be utilized in a variety of operations, including open water tree running tool (TRT) operations.

In an operational example, the modular control system can be used during well construction after a subsea well has been cased and perforated. At this stage, a completion can be run downhole into the subsea wellbore with subsea equipment, e.g. a tubing hanger, THRT, and SSTT. The modular control system is used to maintain well control through the subsea test tree and to conduct well test operations. The well string and riser can then be recovered to the rig, and the TRT can be connected to the well test string along with a Christmas tree, e.g. a horizontal Christmas tree, for subsequent deployment to the subsea well.

In many applications, these types of equipment, e.g. horizontal Christmas trees, are too large to go to the rotary table and are rigged up in the pool area of the rig. While this equipment is rigged up in the moon pool area, the modular control system can be rigged up above the rotary table and the second control module and/or other control modules may be attached as desired for a given application. When the Christmas tree and TRT are ready to be deployed, the modular control system is connected to the TRT and run down through the rotary table so that the entire system may be deployed through open water until the Christmas tree is set at the desired subsea well location. Subsequently, additional flow back operations and/or intervention operations can be connected using the same modular control system via, for example, the added second control module.

Referring generally to FIG. 1, an example of a modular electro-hydraulic control system 20 is illustrated. The modular control system 20 may be attached into a variety of well strings for use in controlling different types of subsea equipment. In the embodiment illustrated, the modular control system 20 comprises a subsea control module 22 which may have a variety of components selected according to the parameters of a desired operation. For example, the subsea control module 22 may have an internal mandrel 24 to which various components are mounted.

In the embodiment illustrated, a plurality of accumulators 26 is mounted about the internal mandrel 24. Additionally, a valve section 27 comprising valves/regulators 28 may be mounted about the mandrel 24 and may be operated in cooperation with hydraulic manifolds 30 to control the supply of hydraulic actuation fluid and/or chemical injection fluid to desired subsea equipment tools, e.g. an SSTT or THRT. By way of example, the valves 28 may be solenoid operated valves. In some applications, an instrumentation module 32 also may be mounted to mandrel 24. By way of example, the instrumentation module 32 may include a gauge package 34.

The illustrated embodiment of modular control system 20 also comprises an additional control module 36, e.g. an open water control module. The control module 36 is easily coupled into the overall control system 20 by suitable connectors, e.g. flange connectors 38. In some applications, at least one of the flange connectors 38 may comprise a crossover flange for coupling a crossover member 40 into the overall modular control system 20. Similarly, other components may be coupled into the control system 20 by flange connectors 38 or by other suitable connectors. For example, a supplemental control module or modules 42 may be added to the control system 20.

Depending on the application, the control modules 22 and/or 36 may be used to control a variety of electrical and/or hydraulic inputs. In some applications, an umbilical 44 is coupled with the modular control system 20 and may comprise hydraulic control lines 46 and/or electrical control lines 48. By way of example, the hydraulic control lines 46 may be used to provide hydraulic control signals to appropriate subsea equipment components, to deliver chemical treatments, and/or to provide other desired hydraulic inputs. In some applications, the entire grouping of hydraulic control lines 46 and/or electrical control lines 48 are encased in the single umbilical 34. However, certain applications may utilize a second umbilical 50 having similar hydraulic, electrical, and/or other control lines. For example, some applications may utilize the first umbilical 44 to encase the hydraulic supply lines 46 while the second umbilical 50 encases the electrical control lines 48. Pressures in the hydraulic control lines 46 may be monitored by the sensors of gauge package 34 or other appropriate sensors in communication with the hydraulic control lines. Sections of umbilicals 44, 50 (or sections of the control lines) also may be routed along the modular control system 20 from the control modules 22, 36 to desired controlled tools of the subsea equipment.

Figure 2:
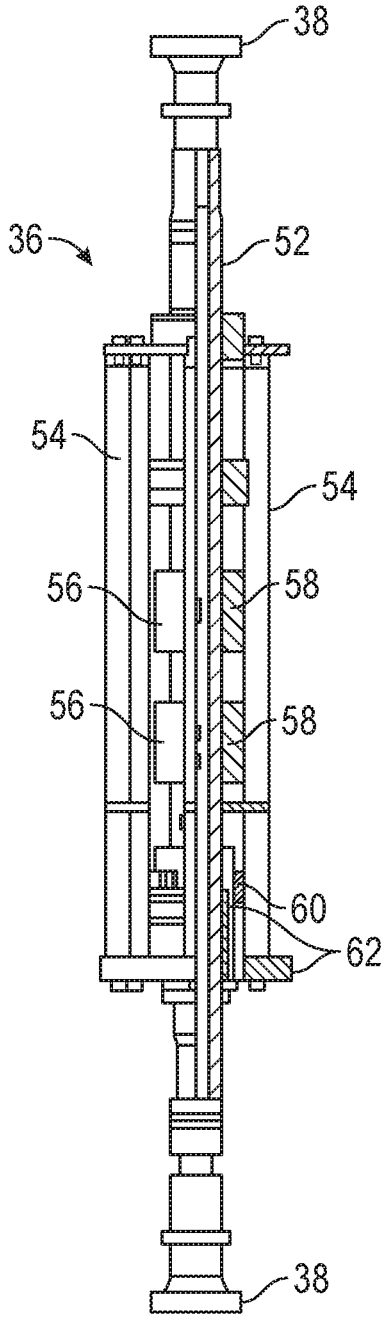
FIG. 2 is an enlarged illustration of an example of a control module, e.g. an open water control model, which can be used with the system illustrated in FIG. 1, according to an embodiment of the disclosure.

With additional reference to FIG. 2, an example of the control module 36 is illustrated. By way of example, the control module 36 may be used as an open water control module. In this embodiment, the control module 36 comprises an inner mandrel 52 which may have a hollow interior for carrying well fluids and also may be coupled with a suitable conveyance, e.g. drill pipe. As with inner mandrel 24, mandrel 52 can be changed depending on the pressure and tension parameters encountered in a given well application. The inner mandrel 24 may comprise or may be coupled with suitable end connectors, such as flange connectors 38 to facilitate connection to other modules.

Additionally, the control module 36, e.g. open water control module, may comprise various other components selectively mountable to inner mandrel 52. For example, a plurality of accumulators 54 may be mounted about the internal mandrel 52. Hydraulic manifolds 56 also may be mounted about internal mandrel 52 and may work in cooperation with a plurality of valves/regulators 58 to control the supply of hydraulic actuation fluid and/or other hydraulic fluid to desired subsea equipment, e.g. an SSTT, THRT, TRT, and/or other controlled tools. By way of example, the valves 58 may be solenoid operated valves. In some applications, an instrumentation module 60 comprising desired sensors 62, e.g. pressure sensors, also may be mounted to internal mandrel 52. By way of example, sensors 62 may be used to monitor pressure in hydraulic lines 46 and/or to monitor other pressures or parameters related to operation of the subsea equipment.

Both the inner mandrel 24 and the inner mandrel 52 are constructed to accommodate high axial loading while also withstanding high bending forces. This enables use of subsea control module 22 and/or additional control module 36 to be used in both in-riser and open water operations. Additionally, the modularity of the system enables easy replacement of one of the control modules 22, 36 or even replacement of the desired internal mandrel 24, 52 so as to accommodate changing pressure and/or tensile loading parameters of a given subsea operation.

Figure 3:
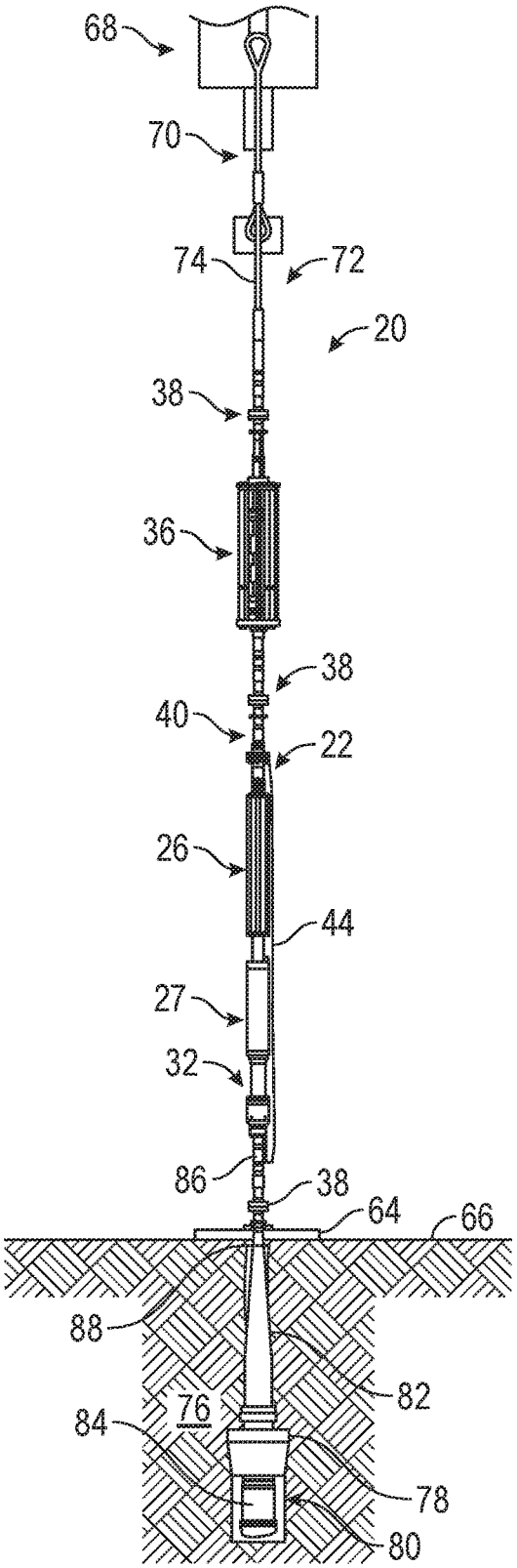
FIG. 3 is an illustration of an example of the modular control system combined with other components and extending through a rotary table, according to an embodiment of the disclosure.

The size of the subsea control module 22 and the additional open water control module 36 also facilitate timely rig-up of components and interchanging of components because the control modules 22, 36 are able to easily pass through a rotary table 64 of a rig 66, as illustrated in FIG. 3. In this example, the overall modular control system 20 is illustrated as coupled with a top drive 68 via a coupling mechanism 70. The top drive 68 may be used to move the modular control system 20 into position over rotary table 64 for coupling into an overall subsea well string 72 which may comprise drill pipe 74 or other types of conveyances. In the example illustrated, the modular control system 20 is assembled into the well string 72 on rig 66 above the rotary table 64.

However, other components of the overall well string 72 may be assembled in a pool area 76 below the rotary table 64. For example, a running tool 78, e.g. a tree running tool, may be coupled with subsea equipment 80 and a stiff transition joint 82 extending below rotary table 64. In the specific example illustrated, the running tool 78 is coupled with a horizontal Christmas tree 84. Depending on the application, additional components may be joined above and/or below rotary table 64. In the example illustrated, a stab plate 86 is located above rotary table 64 and a second stab plate 88 is disposed below rotary table 64. Additionally, another coupling, e.g. flange joint 38, may be positioned to join the components assembled above the rotary table 64 with those assembled below, as illustrated.

Figure 4:
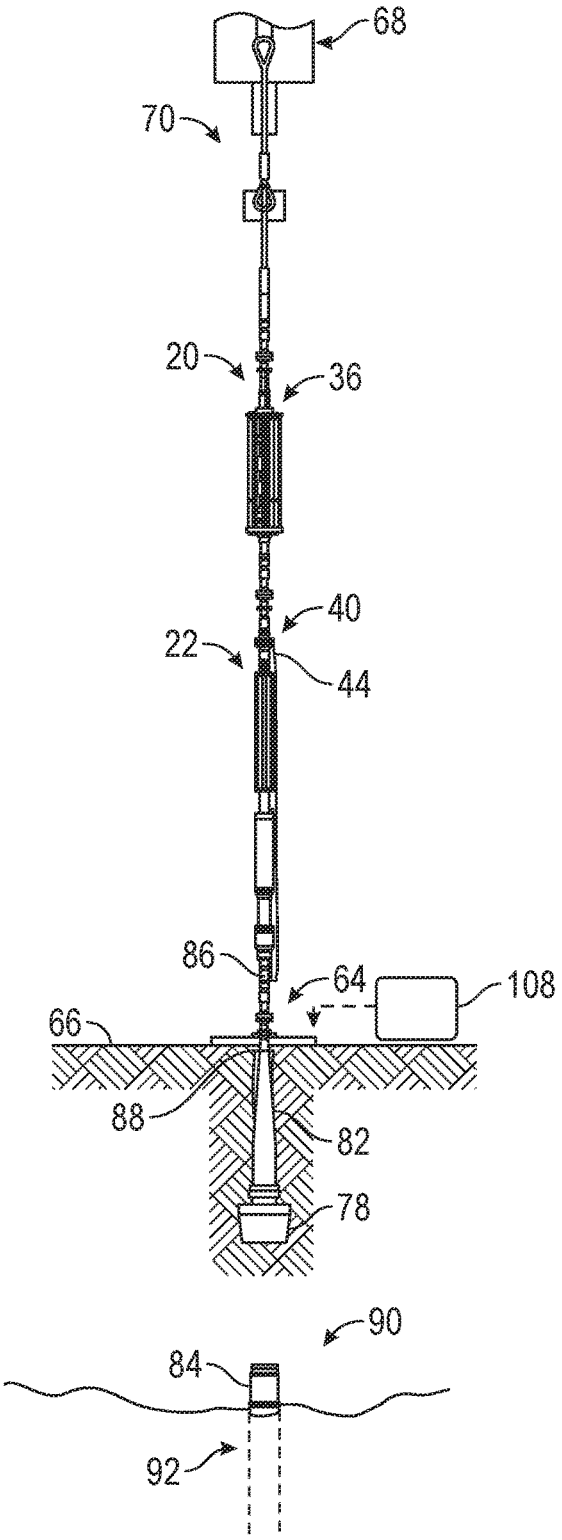
FIG. 4 is an illustration of an example of the modular control system in an open water configuration, according to an embodiment of the disclosure.

In an operational example, the subsea control module 22 and the additional control module 36, e.g. open water control module, of overall modular control system 20 may be used to control running tool 78 during an open water configuration, as illustrated in FIG. 4. In the specific example, the control module 36 may be used in cooperation with subsea control module 22 to control running tool 78. Running tool 78 may be in the form of a tree running tool used to deploy horizontal Christmas tree 84 to a desired subsea location 90 above a well 92.

However, the open water control module 36 may be used in a variety of other open water applications to control other devices, such as a subsea test tree or a tubing hanger running tool. The control module 36 (and subsea control module 22) is constructed with the appropriate components, e.g. manifold 56, valves 58, instrument module 60, sensors 62, to enable use of the control module 36 with a variety of different types of subsea equipment, e.g. subsea tools.

Figure 5:
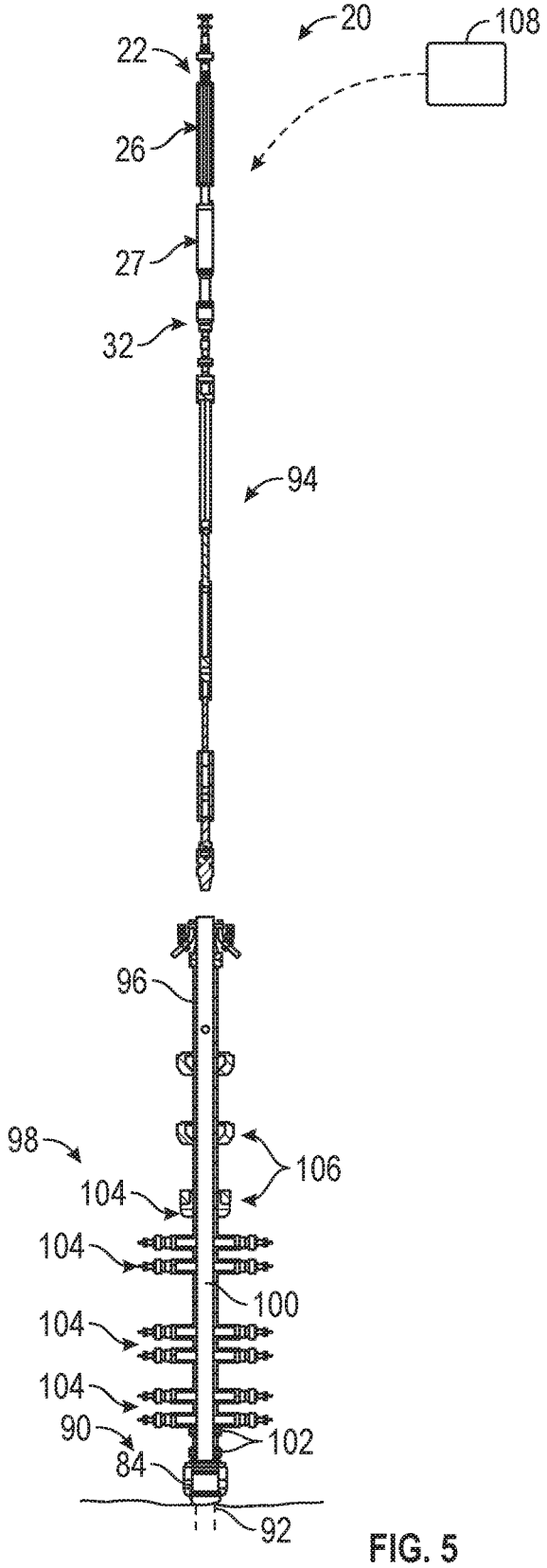
FIG. 5 is an illustration of an example of the modular control system in an in-riser configuration, according to an embodiment of the disclosure.

In another operational example, the modular control system 20 may be used for an in-riser application, as illustrated in FIG. 5. By way of example, the modular control system 20 may be used to control a subsea test tree 94 deployed into a riser 96 for use at a subsea installation 98. In the example illustrated, the subsea test tree 94 is received into an interior 100 of the subsea installation 98. The subsea installation 98 may comprise various components, such as flow line fixtures 102 disposed above horizontal Christmas tree 84. Additionally, the subsea installation may comprise a variety of rams 104, e.g. pipe rams, shear rams, and/or annular rams, as well as other features 106 selected according to the parameters of a given application.

In some applications, the riser 96 may not have a large enough interior diameter to accommodate the control module 36, and/or the subsea equipment, e.g subsea test tree 94, may not utilize the additional control capabilities provided by control module 36. The modularity of the overall control system 20 enables easy removal of control module 36 and/or later addition of control module 36. For example, control module 36 may be added for a subsequent subsea operation, e.g. open water running of a tree running tool 78 with a Christmas tree, and control of another tool, e.g. control of the TRT 78. Similarly, additional modules 42 may be easily added or removed according to the control capabilities desired for a given subsea application.

The modular control system 20 is highly adaptable and may be used in a wide variety of subsea operations to control many types of subsea equipment. For example, the modular control system 20 may be in the form of a modular electro-hydraulic control system, as described above, for use with a subsea wellhead or subsea test tree. The modular control system 20 is able to accommodate high axial loading and also high bending forces by selecting the appropriate inner mandrel 24 and inner mandrel 52 of control modules 22 and 36, respectively. The ability to select appropriate mandrels to handle high axial and bending loads and the modularity of the overall system enables easy adaptation of the modular control system 20 for use in both open water operations and in-riser operations.

The subsea control module 22 and the control module 36 are able to fit through the rotary table 64 of rig 66, e.g. a drilling rig, and also may be constructed with standard configurations for in-riser operations. However, the control module 36 may easily be removed from the overall modular control system 20 if the inner diameter of the riser is too small or if the control features of module 36 are not used for a given operation. Each control module 22, 36 may constructed with the appropriate accumulators, valves, e.g. solenoid operated valves and/or directional control valves, sensors, and/or other components to accommodate the parameters of a given subsea operation. In some applications, the sensors, e.g gauge package 34 of control module 22 and/or sensor 62 of control module 36, may be used to monitor pressure in hydraulic control lines 46.

In some applications, the modular control system 20 may comprise both subsea components and surface components, e.g. a surface control system 108 as illustrated in FIGS. 4 and 5. The surface control system 108 may be used to control the delivery of signals, e.g. hydraulic and/or electric signals, down to control modules 22, 36 through umbilicals 44, 50. The hydraulic control lines 46 and/or electrical control lines 48 may be encased in a single umbilical, e.g. umbilical 44, or a plurality of umbilicals, e.g. umbilicals 44 and 50. In some applications, each umbilical 44, 50 may contain different types of control lines, e.g. hydraulic control lines 46 in umbilical 44 and electrical control lines 48 in umbilical 50. The control lines 46, 48 also may be routed between components of the modular control system 20 and the controlled subsea equipment/tools.

The modularity of the overall control system 20 reduces the time involved in assembling the well string 72 and also provides great flexibility with respect to which components and systems are added for a given subsea application. The construction also enables assembling of some components above rotary table 64 while other components are assembled in the pool area 76 below the rotary table 64. For example, subsea control module 22, open water control module 36, and their cooperating control system components may be assembled above the rotary table 64. However, the subsea Christmas tree 84, lower riser 96, associated riser package components, and tree running tool 78 may be assembled and connected below the rotary table 64.

The stress joint 82 may be located so as to protrude through the rotary table 64 to facilitate coupling of the modular control system 20 with the controlled subsea equipment, e.g. tree running tool 78. The umbilical 44 or umbilicals 44, 50 may be deployed alongside. It should be noted that many other types of controlled subsea equipment, as described above, may be coupled with the modular control system 20 via umbilicals or other types of control lines.

The system and methodologies described herein may be employed in a wide variety of subsea well operations and other subsea operations. The overall structure of the well string 72, e.g. drill string, may vary substantially according to the parameters of a given subsea operation. Similarly, the components of the modular control system 20 also may be selected according to the specifics of the subsea operation. The modularity of system 20 enables the overall control system to be rapidly assembled and/or changed to accommodate different types of devices and systems to be controlled during the subsea operation. Similarly, the components used to construct the subsea control module 22 and/or control module 36 may be selected and/or changed to facilitate the control parameters of the corresponding subsea operation.

Although a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A multi-module electrohydraulic control system for use in a subsea well operation, comprising:

a controllable subsea tool disposed along a well string; and a modular control system coupled into the well string to provide control inputs to the controllable subsea tool, the modular control system comprising:

a first control module selectively connectable into the modular control system to control the controllable subsea tool; and a second control module selectively connectable into the modular control system to provide supplemental control for an additional subsea tool, each of the first control module and the second control module comprising a mandrel, accumulators, flow control valves for hydraulic actuation and chemical injection fluid, and a sensor system, each of the first control module and the second control module being sized to fit through a rotary table of a rig during deployment to a subsea location.

2. The system as recited in claim 1, wherein the mandrel of each of the first and second control modules is selected according to the potential axial loads and bending loads expected during a given subsea operation.

3. The system as recited in claim 2, wherein the mandrel of each of the first and second control modules is changeable to enable substitution of other mandrels selected according to the potential axial loads and bending loads expected during another subsea operation.

4. The system as recited in claim 1, wherein the first control module is a subsea control module.

5. The system as recited in claim 4, wherein the second control module is an open water control module.

6. The system as recited in claim 1, wherein the first and second control modules are operatively coupled to a surface control.

7. The system as recited in claim 1, wherein the modular control system is coupled with an umbilical comprising control lines.

8. The system as recited in claim 7, wherein the control lines comprise hydraulic control lines.

9. The system as recited in claim 7, wherein the control lines comprise electrical control lines.

10. The system as recited in claim 7, wherein the modular control system is coupled with an additional umbilical containing additional control lines.

11. The system as recited in claim 1, wherein the first control module and the second control module are coupled into the modular control system via flange connectors.

12. A method, comprising:

assembling a modular control system above a rotary table of a rig by joining a plurality of control system components including a removable control module with one of manifolds and valves to control the supply of hydraulic actuation fluid and chemical injection fluid;

coupling together subsea equipment, including at least one tool controllable by the removable control module, below the rotary table;

joining the modular control system and the subsea equipment via a stress joint; and deploying the modular control system as a multi-module electrohydraulic control system through the rotary table when the subsea equipment is conveyed to a subsea well.

13. The method as recited in claim 12, wherein assembling comprises coupling an additional control module into the modular control system above the rotary table.

14. The method as recited in claim 13, wherein coupling the additional control module comprises coupling an open water control module into the control system above the rotary table.

15. The method as recited in claim 13, further comprising interchanging at least one of the removable control module or the additional control module with a different control module.

16. The method as recited in claim 13, further comprising using the control module and the additional control module to control a plurality of different tools in subsea operations.

17. The method as recited in claim 12, wherein coupling together comprises coupling a controllable tree running tool with a subsea tree.

18. The method as recited in claim 17, further comprising coupling an umbilical with the modular control system to enable the relay of hydraulic signals to the controllable tree running tool.

19. A multi-module electrohydraulic control system, comprising:

a modular control system sized for movement through a rotary table of a surface rig, the modular control system comprising interchangeable control modules having an interchangeable mandrel selected to absorb the potential axial and bending loads of a subsea operation, the interchangeable control modules each further comprising a plurality of accumulators mounted around the interchangeable mandrel, a plurality of valves to control flow of hydraulic control signals and chemical injection fluid; and at least one sensor to monitor hydraulic pressure in the modular control system.

20. The system as recited in claim 19, wherein one of the modules is an open water control module removably coupled into the modular control system, the open water control module being sized for movement through the rotary table.

* * * * *